US009612009B2

(12) United States Patent
Goodwin et al.

(10) Patent No.: US 9,612,009 B2
(45) Date of Patent: Apr. 4, 2017

(54) DESUPERHEATER AND SPRAY NOZZLES THEREFOR

(71) Applicant: FISHER CONTROLS INTERNATIONAL LLC, Marshalltown, IA (US)

(72) Inventors: Justin Paul Goodwin, Marshalltown, IA (US); Jesse Creighton Doyle, Ames, IA (US)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 457 days.

(21) Appl. No.: 14/149,302

(22) Filed: Jan. 7, 2014

(65) Prior Publication Data

US 2015/0128882 A1 May 14, 2015

Related U.S. Application Data

(60) Provisional application No. 61/901,583, filed on Nov. 8, 2013.

(51) Int. Cl.
*F22G 5/12* (2006.01)

(52) U.S. Cl.
CPC ..... *F22G 5/123* (2013.01)

(58) Field of Classification Search
CPC . F22G 5/12; F22G 5/123; F22G 5/126; F22G 5/14; B05B 7/04; B05B 7/06
USPC ..... 122/487; 239/423, 424, 424.5, 425, 433
See application file for complete search history.

(56) References Cited

U.S. PATENT DOCUMENTS 2,207,646 A * 7/1940 Van Der Ploeg ..... A23L 3/18 122/459
2,293,314 A * 8/1942 Spence ..... F22G 5/12 236/1 E
3,034,771 A * 5/1962 Harris ..... F22G 5/12 122/459
3,092,677 A * 6/1963 Dexter ..... F22G 5/12 122/459
3,219,323 A * 11/1965 Dexter ..... C21D 9/0037 122/459
3,904,722 A * 9/1975 Onoda ..... F22G 5/126 261/118
5,005,605 A * 4/1991 Kueffer ..... F01D 17/145 137/625.39
5,380,470 A * 1/1995 Jacobsson ..... F16K 47/04 261/16

(Continued)

*Primary Examiner* — Steven B McAllister
*Assistant Examiner* — Steven Anderson, II
(74) *Attorney, Agent, or Firm* — Marshall, Gerstein & Borun LLP

(57) ABSTRACT

A steam assisted ring style desuperheater includes a ring body defining an axial flow path and one or more spray nozzles extending through a wall of the ring body. Each of the nozzles is connected to a separate cooling water manifold and atomizing steam manifold to conduct cooling water and atomizing steam separate from each other through the spray nozzle to an injection point. An atomizing head of each nozzle combines the cooling water and atomizing steam to form a spraywater cloud that is injected radially into the axial flow path. The spray nozzles include one or more flow passage inserts that define separate first and second fluid flow paths for conducting the cooling water and the atomizing steam separately through the spray nozzle.

17 Claims, 4 Drawing Sheets

(56) References Cited

U.S. PATENT DOCUMENTS

| | | | | |
|---|---|---|---|---|
| 6,691,929 | B1 * | 2/2004 | Sherikar | B05B 7/0075<br>239/132.3 |
| 2005/0236747 | A1 * | 10/2005 | Rue | C03B 5/2356<br>266/217 |
| 2009/0065295 | A1 * | 3/2009 | Sherikar | F16L 55/02781<br>181/233 |
| 2009/0278266 | A1 * | 11/2009 | Freitas | B05B 1/06<br>261/62 |

* cited by examiner

DESUPERHEATER AND SPRAY NOZZLES THEREFOR

CROSS-REFERENCE TO RELATED APPLICATIONS

This application claims priority from U.S. Provisional Application No. 61/901,583, filed on Nov. 8, 2013, the contents of which are expressly incorporated by reference herein in its entirety for all purposes.

FIELD OF THE INVENTION

The present invention relates to desuperheaters, which are commonly used on fluid and gas lines (e.g., steam lines) in the power and process industries, and further relates to spray nozzles for use with desuperheaters.

BACKGROUND

Desuperheaters are used in many industrial fluid and gas lines to reduce the temperature of superheated process fluid and gas to a desired set point temperature. For example, desuperheaters are used in power process industries to cool superheated steam. The desuperheater injects a fine spray of atomized cooling water or other fluid, referred to herein as a spraywater cloud, into the steam pipe through which the process steam is flowing. Evaporation of the water droplets in the spraywater cloud reduces the temperature of the process steam. The resulting temperature drop can be controlled by adjusting one or more control variables, such as the volume rate of injecting the cooling water and/or the temperature of the cooling water. The size of the individual droplets in the spraywater cloud and/or the pattern of the spraywater cloud can also be adjusted to control the time required for the temperature drop.

Typically, a spraywater cloud requires some minimum length or run of straight pipe downstream from the injection point to ensure substantially complete evaporation of the individual atomized water droplets. Otherwise, the spraywater cloud may condense or not completely evaporate when a bend or split in the steam pipe is encountered. This length or run of straight pipe is typically referred to as a "downstream pipe length." A temperature sensor is also usually located at the end of the downstream pipe length to sense the resulting temperature drop of the steam.

Desuperheaters typically are one of two main functional varieties: either mechanically atomized or steam assisted. A mechanically atomized desuperheater relies solely on the mechanical flow of the cooling water through an atomizing head to atomize the cooling water in the spraywater cloud. The cooling water flows into the atomizing head, which forms the spraywater cloud and injects the spraywater cloud into the steam pipe.

A steam assisted desuperheater includes an atomizing head that combines a high velocity stream of steam, which is called atomizing steam, with a stream of cooling water to atomize the cooling water and produce the spraywater cloud. In steam assisted desuperheaters, the individual droplets in the spraywater cloud are typically smaller in size than in mechanically atomized desuperheaters and, therefore, evaporate more rapidly inside the steam pipe. Therefore, steam assisted desuperheaters may be used in applications where a shorter downstream pipe length is available.

FIG. 1 illustrates a typical steam assisted insertion style desuperheater 10. The desuperheater 10 includes an insertion tube 11 that projects radially into a steam pipe 12 that carries process steam. The insertion tube 11 disposes a single atomizing head 13 at a central region of the pipe cross-section. The atomizing head 13 is directed to inject a spraywater cloud 14 axially along an axis 19 of the pipe 12. As used herein, the term axially is used to mean that the axis of the spraywater cloud 14 is angularly aligned more closely with the axis 19 of the pipe than with a radius of the pipe, preferably within less than about 45° of the axis 19, more preferably within less than about 5-10° of the axis 19, and most preferably parallel or coaxial with the axis 19 of the pipe 12. An atomizing steam control valve 15 controls the flow of atomizing steam to the desuperheater 10. A spraywater control valve 16 controls the flow of cooling water to the desuperheater 10. The insertion tube 11 conducts each of the atomizing steam and the cooling water separately to the atomizing head 13. The atomizing head 13 mixes the atomizing steam and the cooling water and injects the resulting spraywater cloud axially into the flow stream of process steam. The body pipe 11, however, can cause eddies and vortices in the flow of process steam. These vortices can cause undesirable vibrations or have other undesirable affects on the desuperheater. Furthermore, the downstream pipe length 17 between the desuperheater 10 and a temperature sensor 18 for this type of desuperheater can be thirty feet or more, depending on many factors, which, due to space constraints in many industrial settings, can be problematic.

FIG. 2 shows a typical mechanically atomized ring style desuperheater 20 that addresses some of the constraints with the steam assisted insertion style desuperheater 10. The ring style desuperheater 20 injects one or more spraywater clouds radially into the flow of process steam, rather than axially, as with the insertion style desuperheater 10. The ring style desuperheater 20 includes a ring body 21 and one or more nozzles 22 disposed around the circumference of the ring body 21. The ring body 21 may be an axial pipe segment through which the process steam travels axially. A spraywater manifold 23 provides cooling water to the nozzles 22. The spraywater manifold 23 is formed of various pipes that connect the nozzles 22 to a source of cooling water. Each nozzle 22 has an atomizing head 24 disposed along an interior surface of the ring body 21. The atomizing head 24 injects a spraywater cloud radially into the axial flow of steam. The ring style desuperheater 20 overcomes or significantly reduces problems with vortex eddies and vibrations that may occur with the insertion style desuperheater 10 because the ring style desuperheater 20 does not have a body pipe 11. The ring style desuperheater 20 provides more flexibility for steam lines that have greater variance of steam flow characteristics because the number of nozzles 22 may be increased or decreased to provide more or less cooling spraywater into the process steam. Further, the downstream pipe length often is shorter with the ring style desuperheater 20 than with the insertion style desuperheater 10 because the nozzles 22 inject the spraywater clouds radially. Until now, however, ring style desuperheaters have been limited to being of the mechanically atomized variety.

SUMMARY

According to some aspects of the present disclosure, a steam assisted ring style desuperheater is provided that does not include an insertion-style tube that would be subject to vortex shedding problems. In some arrangements exemplary of this aspect, the desuperheater includes one or more spray nozzles having atomizing heads disposed around a ring body and separate manifolds that provide cooling water and atomizing steam to each of the spray nozzles.

According to other aspects of the present disclosure, a spray nozzle for a steam assisted ring style desuperheater maintains the atomizing steam and the cooling water physically separate from each other up to an injection point, preferably at the atomizing head. In some arrangements exemplary of this aspect, a steam assisted ring style desuperheater includes one or more spray nozzles, each including a water flow passage and an atomizing steam flow passage. The water flow passage and the atomizing steam flow passage are maintained separate from each other along the spray nozzle and converge only at the injection point at the atomizing head. Preferably, one or both of the water flow passage and the atomizing steam flow passage are formed by one or more flow passage inserts disposed in a cavity, such as a bore, of a nozzle housing.

In one exemplary arrangement, desuperheater includes a ring body defining an axial flow path, a plurality of spray nozzles disposed around the ring body, a water manifold connected to each of the spray nozzles for providing the cooling water to each of the spray nozzles, and a steam manifold connected to each of the spray nozzles for providing the atomizing steam to each of the spray nozzles, separately from the cooling water. Each spray nozzle includes an atomizing head that combines cooling water and atomizing steam to form a spraywater cloud and injects the spraywater cloud radially into the axial flow path.

In another exemplary arrangement, a ring style steam assisted desuperheater includes a ring body having a wall defining an axial flow path extending from a first end of the ring body to a second end of the ring body, a steam manifold arranged to provide atomizing steam, a water manifold arranged to provide cooling water; and a spray nozzle operatively connected to each of the steam manifold and the water manifold. The spray nozzle extends through an aperture in the wall of the ring body and includes a housing coupled to the wall of the ring body, at least one flow passage insert received within the bore and extending through the first end of the housing, and an atomizing head operatively coupled to the at least one flow passage insert and disposed inside the ring body and adjacent the wall of the ring body. The housing includes a bore extending between a first end of the housing and a second end of the housing. The at least one flow passage insert defines at least a first fluid flow path in fluid communication with the water manifold to conduct the cooling water through the spray nozzle and a second fluid flow path in fluid communication with the steam manifold to conduct the atomizing steam through the flow passage, separate from the cooling water. The atomizing head combines the atomizing steam and the cooling water to form a spraywater cloud and directs the spraywater cloud radially into the ring body.

In another exemplary arrangement, a spray nozzle for a steam assisted ring type desuperheater includes a housing having a bore extending from a first end of the housing to a second end of the housing, a first inlet aperture extending through the housing and intersecting the bore, and a second inlet aperture extending through the housing and intersecting the bore. A first flow passage insert is received within the bore and forms a first fluid flow path extending from the first inlet aperture to a distal end of the first flow passage insert. A second flow passage insert is received within the first flow passage insert and forms a second fluid flow path, separate from the first flow path, extending from the second inlet aperture to a distal end of the second flow passage insert. A first seal is operatively disposed between the first flow passage insert and the housing to fluidly isolate the first fluid flow path from the second fluid flow path. An atomizing head is disposed at the distal end of the first flow passage insert and the distal end of the second flow passage insert and has a first flow passage operatively connected to the first fluid flow path and a second flow passage operatively connected to the second fluid flow path. The first flow channel and the second flow channel converge proximate an injection point.

In a further exemplary arrangement, a spray nozzle for a steam assisted ring type desuperheater includes a housing having a bore extending from a first end of the housing to a second end of the housing, a first inlet aperture extending through the housing and intersecting the bore, and a second inlet aperture extending through the housing and intersecting the bore. A flow passage insert is received within the bore and forms a first fluid flow path and a second fluid flow path, fluidly separated from the first fluid flow path between the first and second inlet apertures and a distal end of the flow passage insert. An atomizing head is disposed at the distal end of the flow passage insert and has a first flow passage in fluid communication with the first fluid flow path and the first inlet aperture and a second flow passage in fluid communication with the second fluid flow path and the second inlet aperture. The first fluid flow path and the second fluid flow path converging proximate an injection point where a spraywater cloud is injected radially into the bore.

In further accordance with any one or more of the foregoing aspects and exemplary arrangements, a desuperheater assembly, desuperheater, spray nozzles, and/or components thereof according to the teachings of the present disclosure may include any one or more of the following optional forms.

In some optional forms, the water manifold includes a first conduit operatively connected to each of the spray nozzles and arranged to carry the cooling water to the spray nozzles and the steam manifold comprises a second conduit operatively connected to each of the spray nozzles and arranged to carry the atomizing steam to each of the spray nozzles.

In some optional forms, each spray nozzle includes a first fluid flow path in fluid communication with the water manifold and a second fluid flow path, separate from the first fluid flow path, in fluid communication with the steam manifold.

In some optional forms, each spray nozzle includes a flow passage insert in fluid communication with the atomizing head and the steam manifold and a second flow passage insert in fluid communication with the atomizing head and the water manifold. The flow passage insert has a bore formed therethrough that defines the second fluid flow path and the second flow passage insert has a bore formed therethrough that, in combination with the flow passage insert, defines the first fluid flow path.

In some optional forms, each spray nozzle further includes a flow passage insert having an inner bore formed axially therethrough and an outer annular bore surrounding and radially spaced form the inner bore. The inner bore is in fluid communication with the atomizing head and the steam manifold and defines the second fluid flow path and the outer annular bore is in fluid communication with the atomizing head and the water manifold and defines the first fluid flow path.

In some optional forms, the water manifold and the steam manifold are disposed on an exterior side of the ring body, each spray nozzle extends through an aperture formed in the ring body, and the atomizing heads of the spray nozzles are disposed adjacent an inner wall of the ring body.

In some optional forms, the spray nozzle comprises a single flow passage forming both the first fluid flow path and the second fluid flow path.

In some optional forms, the spray nozzle includes a first flow passage insert received within the bore and extending through the first end of the housing and a second flow passage insert received within the first flow passage insert. The second fluid flow path is defined by the second flow passage insert and the first fluid flow path is defined by the first flow passage insert and the second flow passage insert.

In some optional forms, the bore includes a first portion, a second portion, and a third portion. The first portion has a first diameter and receives a hollow tube of the first flow passage insert. The second portion has a second diameter greater than the first diameter and receives a head of the first flow passage insert. The third portion has a third diameter greater than the second diameter and receives a head of the second flow passage insert. A first step is formed between the first portion and the second portion and is configured to engage a shoulder formed on the head of the first flow passage insert. A second step is formed between the second portion and the third portion and is configured to engage a shoulder formed on the head of the second flow passage insert.

In some optional forms, a second seal is operatively disposed between first flow passage insert and the housing.

In some optional forms, a cap flange is secured to the first end of the housing sealing the bore. The cap flange secures the first flow passage insert and the second flow passage insert within the bore.

In some optional forms, a third seal is operatively disposed between the cap flange and the housing.

In some optional forms, the bore includes a first portion having a first diameter and receiving a tubular section of the flow passage insert, a second portion having a second diameter greater than the first diameter and receiving a head of the flow passage insert, and a step formed between the first portion and the second portion. The step is configured to engage an annular shoulder formed on the head of the flow passage insert.

In some optional forms, the first fluid flow path includes an outer annular bore extending axially along the tubular section to a first flow passage formed in the head and the second fluid flow path comprises an inner bore disposed within the outer annular bore and extending axially along the tubular section to a second flow passage formed in the head. The first flow passage is in fluid communication with the first inlet aperture and the second flow passage is in fluid communication with the second inlet aperture.

In some optional forms, a cap flange is secured to the first end of the housing. The cap flange seals the bore and secures the flow passage insert within the bore.

Other aspects and optional forms of the desuperheater assembly, desuperheater, spray nozzles, and/or components thereof disclosed herein will be apparent upon consideration of the following detailed description and the appended drawings.

DETAILED DESCRIPTION

Figure 3:
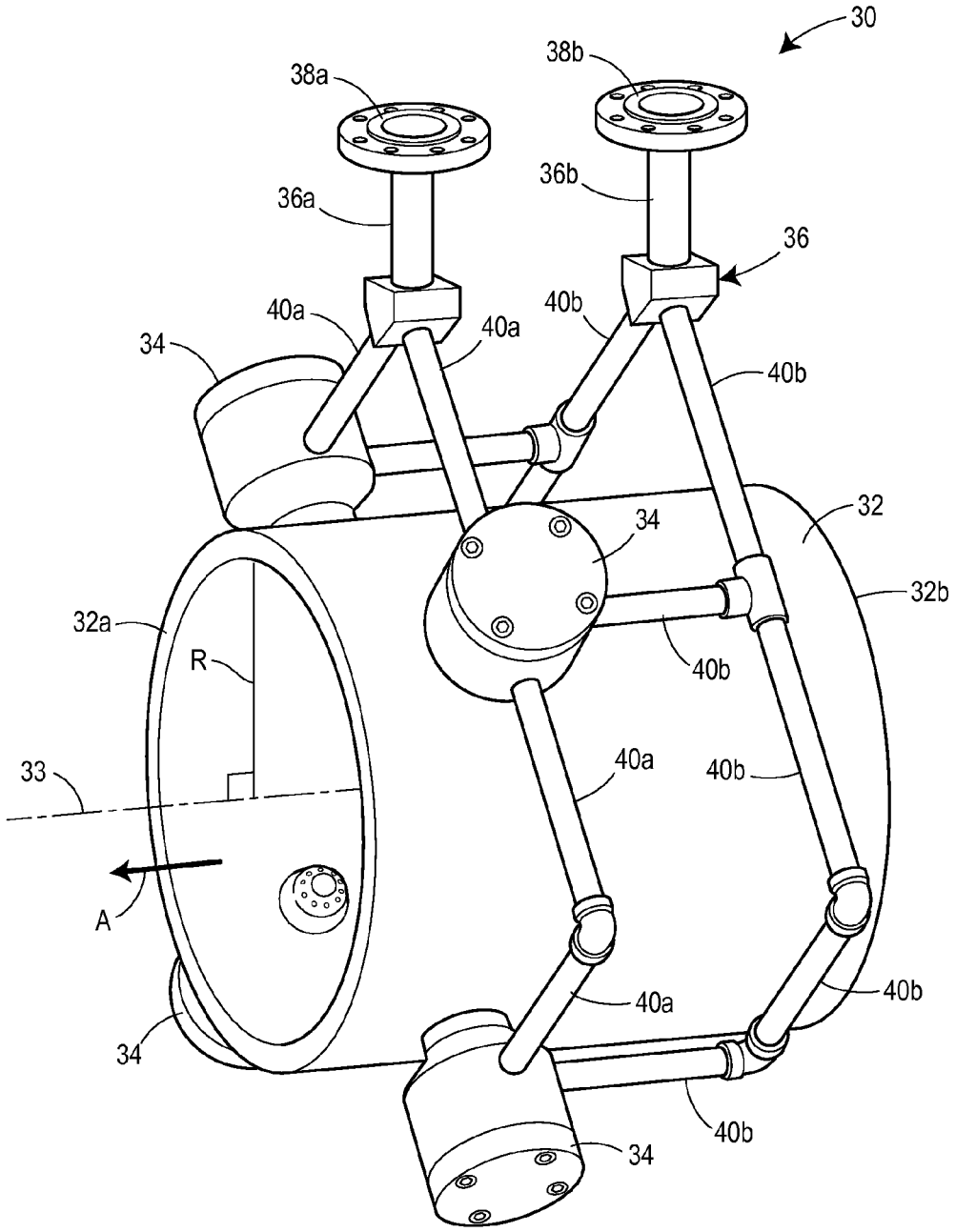
FIG. 3 is an isometric view of an example desuperheater according to the teachings of the present disclosure.

Turning now to the drawings, FIG. 3 illustrates an example of a desuperheater 30 according to one or more teachings of the present disclosure. The desuperheater 30 is a ring style desuperheater and is also a steam assisted desuperheater. The desuperheater 30 includes a ring body 32, at least one and preferably a plurality of spray nozzles 34 carried by the ring body, and a manifold 36 for providing cooling water and atomizing steam to each of the spray nozzles 34. The manifold 36 is disposed on a radially exterior side of the ring body 32. The manifold 36 is connected to a portion of each spray nozzle 34 disposed on the exterior side of the ring body 32. Each spray nozzle 34 is arranged to inject a spraywater cloud radially into the flow stream of process steam passing axially through the ring body 32. The term "radially" is used herein to mean that the axis of the spraywater cloud is angularly aligned more closely with the radius R of the ring body 32 than with the axis 33 of the ring body 32, preferably within less than about 45° of the radius R, more preferably within less than about 5-10° of the radius R, and most preferably parallel or aligned with the radius R of the of the pipe 12, while outer portions of the spraywater cloud may include both a radial component and an axial component.

Figure 1:
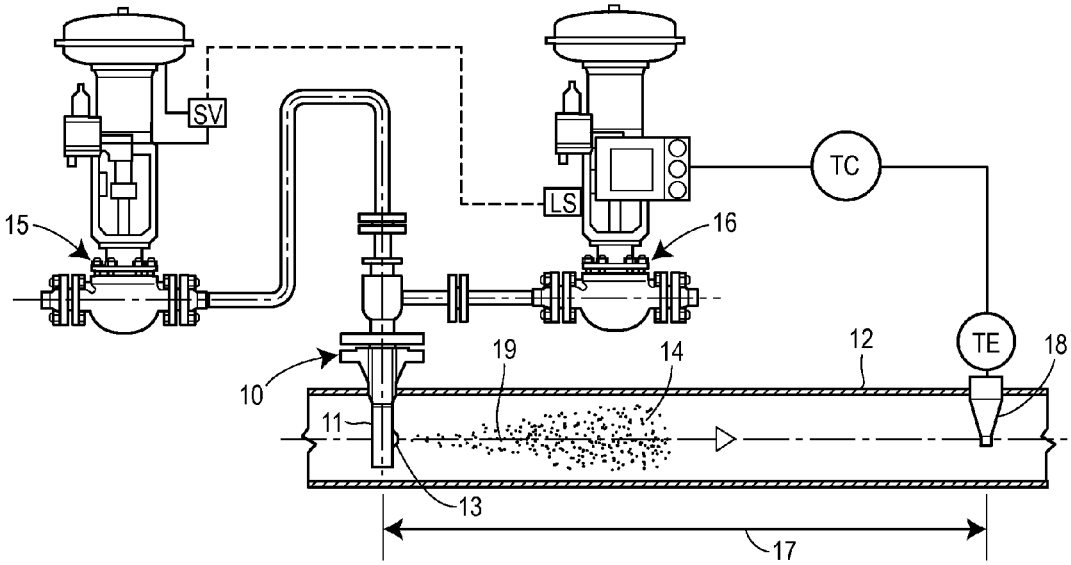
FIG. 1 PRIOR ART
FIG. 1 is a schematic diagram of a steam assisted insertion style desuperheater assembly according to the prior art operatively installed in a steam pipe.
Figure 2:
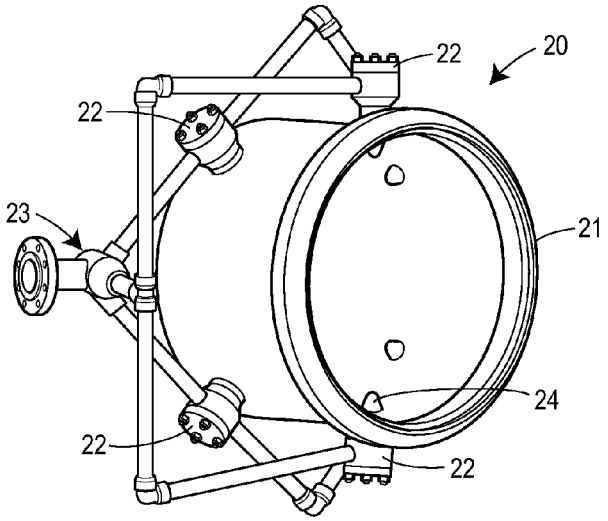
FIG. 2 PRIOR ART
FIG. 2 is an isometric view of a mechanically atomized ring style desuperheater according to the prior art.

The ring body 32 defines an axial flow path "A" for the passage of fluid, such as process steam, therethrough. The ring body 32 is preferably in the form of an elongate pipe section having a ring shaped cross-section extending axially from a first end 32*a* to a second end 32*b*. The first and second ends 32*a* and 32*b* are arranged for connection and/or insertion between two opposing ends of pipe along a process steam pipeline, such as the steam pipe 12 of FIG. 1. The first and second ends 32*a* and 32*b* may be connected to opposing ends of pipe by, for example, welding, couplings, or fasteners. The ring body 32 optionally may include connection flanges (not shown) at each of the first and second ends 32*a* and 32*b* for bolted connection to opposing pipe sections in a manner well understood in the art.

The manifold 36 includes two separate and independent portions: a water manifold 36*a*, and a steam manifold 36*b*. The water manifold 36*a* includes a connection 38*a* for connecting to a source of cooling water and one or more conduits 40*a* that operatively connect the connection 38*a* with each of the spray nozzles 34 to provide cooling water to the spray nozzles 34. The source of cooling water may be, for example, the spraywater control valve 16 of FIG. 1. The conduits 40*a* may be connected with one or more of the spray nozzles 34 in series, as shown in the present example, and/or in parallel. The steam manifold 36*b* includes a connector 38*b* for connecting to a source of atomizing steam and one or more conduits 40*b* that operatively connect the connector 38*b* with each of the spray nozzles 34. The source of atomizing steam may be, for example, the atomizing steam control valve 15 of FIG. 1. The conduits 40*b* may be connected with one or more of the spray nozzles 34 in parallel, as shown in the present example, and/or in series. The connections 38*a* and 38*b* may be connector flanges or other well known piping connections, such as butt-welds, socket weld ends, etc. The conduits 40*a* and 40*b* may be pipes, hoses, or other similar fluid conduits. In this arrangement, the water manifold 36*a* provides cooling water to each of the spray nozzles 34, and the steam manifold 36*b* supplies atomizing steam to each of the spray nozzles 34. The cooling water and the atomizing steam are provided separately and independently of each other to each of the spray nozzles 34.

Figure 4:
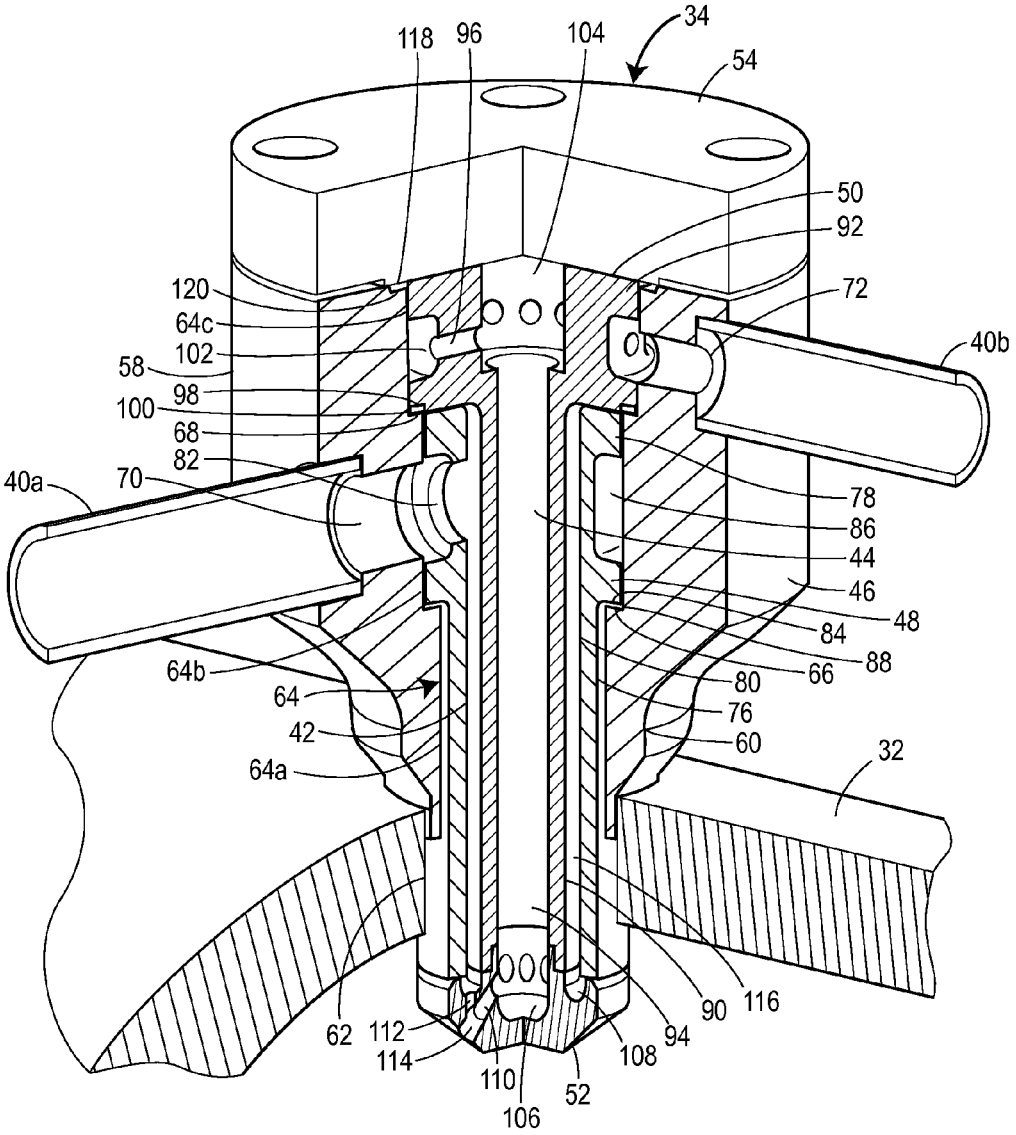
FIG. 4 is an enlarged isometric view in partial cutaway of a nozzle of the desuperheater shown in FIG. 3.

FIG. 4 illustrates an enlarged cutaway view of one of the spray nozzles 34 operatively positioned in the ring body 32. Each of the spray nozzles 34 is preferably identical and/or identically arranged through the ring body 32. The spray nozzle 34 is adapted to receive and to conduct the cooling water and atomizing steam separately and independently to an atomizing head 52. The atomizing head 52 injects a spraywater cloud radially toward a center of the ring body 32. The spraywater cloud is a mixture of the atomizing steam and the cooling water. The spray nozzle 34 includes a housing 46 for connection to the ring body 32, a first flow passage insert 48 and a second flow passage insert 50 received within the housing 46, an atomizing head 52, and a cap flange 54.

The housing 46 includes a body 58 and a neck 60 extending from the body. The neck 60 is narrower than the body 58. Preferably each of the body 58 and the neck 60 has a circular cross-section, although other shapes are possible. The body 58 is disposed on the exterior side of the ring body 32. The neck 60 fits into an aperture 62 through the wall of the ring body 32. The neck 60 is secured to the wall of the ring body 32, such as with one or more welds. Preferably, the weld seals the aperture 62. A through bore 64 extends axially from a first open end at a distal end of the neck 60, through the body 58, to a second open end at the body 58 opposite the first open end. The through bore 64 is a stepped through bore. A first annular step 66 and a second annular step 68 divide the through bore 64 into a first bore portion 64*a*, a second bore portion 64*b*, and a third bore portion 64*c*. The first bore portion 64*a* extends from the first end of the through bore 64 at the distal end of the neck 60 to the first annular step 66. The second bore portion 64*b* extends from the first annular step 66 to the second annular step 68. The third bore portion 64*c* extends from the second annular step 68 to the second end of the through bore 64 at the upper surface of the body 58. The first bore portion 64*a* is narrower than the second bore portion 64*b*. The second bore portion 64*b* is narrower than the third bore portion 64*c*. Preferably, each of the first, second, and third bore portions 64*a*, 64*b*, and 64*c* is in the form a straight cylindrical bore portion, wherein the first bore portion 64*a* has a first diameter, the second bore portion 64*b* has a second diameter larger than the first bore portion, and the third bore portion 64*c* has a third diameter larger than the second diameter. The first through third bore portions 64*a-c* are coaxially aligned along a single axis of the through bore 64.

At least one first or lower inlet/outlet aperture 70 extends radially through the body 58 into the second bore portion 64*b*. Preferably at least two lower inlet/outlet apertures extend radially through the body 58 into the second bore portion 64*b*. At least one second or upper inlet/outlet aperture 72 extends radially through the body 58 into the third bore portion 64*c*. Preferably, at least two upper inlet/outlet apertures 72 extend radially through the body 58 into the third bore portion 64*c*. The upper inlet/outlet apertures 72 may be aligned 180° diametrically opposite each other on opposite sides of the body 58. The lower inlet/outlet apertures 70 may aligned 180° diametrically opposite each other on opposite sides of the body 58. The upper inlet/outlet apertures 72 are angularly offset from the lower inlet/outlet apertures 70, preferably orthogonally. Each of the upper and lower inlet/outlet apertures 72, 70 is arranged to operatively connect to one of the conduits 40*a* or 40*b* to direct a flow of water and/or steam into the through bore 64. The upper and lower inlet/outlet apertures 72, 70 may, for example, receive the ends of the conduits 40*a* or 40*b* therein. Preferably, one or more of the lower inlet/outlet apertures 70 are connected to the conduits 40*a* for providing cooling water to the spray nozzles 34, and one or more of the upper inlet/outlet apertures 72 are connected to the conduit 40*b* for providing atomizing steam to the spray nozzle 34. However, the atomizing steam and cooling water connections may be reversed and the spray nozzle 34 would still be operative. If fewer than all of the inlet/outlet apertures 70 and 72 are connected to conduits 40*a* or 40*b*, a plug or other closure member (not shown) may close any of the inlet/outlet apertures 70 or 72 that are not operatively connected to a conduit 40*a* or 40*b*.

The first flow passage insert 48 is received within the through bore 64. The first flow passage insert 48 at least partially defines a first fluid flow path 42 from the lower inlet/outlet apertures 70 to the atomizing head 52. The first flow passage insert 48 includes a hollow tube 76, a head 78, an inner bore 80, and one or more flow apertures 82. The hollow tube 76 extends from the head 78 to a distal end. The inner bore 80 extends axially through the hollow tube 76 and the head 78 from a first open end at the distal end of the hollow tube 76 to a second open end at the head 78. Preferably, two or more flow apertures 82 extend through the head 78 into the inner bore 80. The flow apertures 82 extend radially through the head 78. The head 78 is wider than the hollow tube 76. Preferably, one or both of the hollow tube 76 and the head 78 have circular cross-sections, and the head 78 has an outside diameter that is larger than the outside diameter of the hollow tube 76. An annular shoulder 84 extends radially from the outside diameter of the head 78 to the outside diameter of the hollow tube 76. The annular shoulder 84 forms a radial seating surface. In other arrangements, the radial seating surface may have different forms. The head 78 is disposed in the second bore portion 64*b*. The hollow tube 76 extends through the first bore portion 64*a*. The hollow tube 76 extends beyond the first end of the through bore 64 and the neck 60. The annular shoulder 84 is operatively seated directly or indirectly against the first annular step 66 to maintain the head 78 within the second bore portion 64*b*. A first annular groove 86 extends circumferentially around the outer diameter surface of the head 78. The annular groove 86 is axially spaced between a top end of the head 78 and the annular shoulder 84. The annular groove 86 connects one or more, and preferably all of the flow apertures 82 along the outer surface of the head 78. Fluid can travel along the annular groove 86 between the inner surface of the second bore section 64*b* and the head 78. A seal 88, such as a gasket or o-ring, is preferably sealingly disposed between the annular shoulder 84 and the first annular step 66 to provide a fluid tight seal between the housing 46 and the first flow passage insert 48. The annular shoulder 84 seats against the seal 88 and/or the first annular step 66 to operatively maintain the first flow passage insert 48 with the flow apertures 82 in fluid communication, and preferably radially aligned, with the lower inlet/outlet apertures 70. The outside diameter of the head 78 corresponds to the inside diameter of the second bore portion 64*b* to provide a tight slip fit therewith.

The second flow passage insert 50 is received within the through bore 64 and within the inner bore 80 of the first flow passage insert 48. The second flow passage insert 50 at least partly defines a second fluid flow path 44 from the upper inlet/outlet apertures 72 to the atomizing head 52. The second flow passage insert 50 includes a hollow tube 90, a head 92, a bore 94, and one or more flow apertures 96. The hollow tube 90 extends from the head 92 to a distal end. The bore 94 extends axially through the hollow tube 90 and the head 92 from a first open end at the distal end of the hollow tube 90 to a second open end at the head 92. The flow apertures 96 extend through the head 92 into the bore 94. The flow apertures 96 extend radially through the head 92. The head 92 is wider than the hollow tube 90. Preferably, one or both of the hollow tube 90 and the head 92 have circular cross-sectional shapes, and the head 92 has an outside diameter that is larger than the outside diameter of the hollow tube 90. An annular shoulder 98 extends radially from the outside diameter of the head 92 to the outside diameter of the hollow tube 90. The annular shoulder 98 forms a second radial seating surface. In other arrangements, the second radial seating surface may have different forms. The hollow tube 90 is disposed coaxially inside of the hollow tube 76 of the first flow passage insert 48. The head 92 is disposed in the third bore portion 64*c* of the housing 46. The annular shoulder 98 operatively seats directly or indirectly against the top surface of the head 78 of the first flow passage insert 48. In addition, the annular shoulder 98 operatively seats directly or indirectly against the second annular step 68 of the housing 46. A seal 100, such as an o-ring or gasket, preferably is disposed between the annular shoulder 98 and the second annular step 68. The seal 100 forms a fluid tight seal operatively between the first flow passages insert 48 and the second flow passage insert 50. A second annular groove 102 extends circumferential around the outer diameter surface of the head 92. The annular groove 102 is axially spaced between a top end of the head 92 and the annular shoulder 98. The annular groove 102 connects one or more, and preferably all, of the flow apertures 96 along the outer circumferential surface of the head 92. Fluid can travel along the annular groove 102 between the inner surface of the third bore section 64*c* and the head 92. A fluid convergence chamber 104 is optionally disposed at the top end of the bore 94. The fluid convergence chamber 104 is aligned radially with the flow apertures 96. The fluid convergence chamber 104 is disposed within the head 92 and has a larger diameter than the bore 94. The annular shoulder 98 of the second flow passage insert 50 seats against the top surface of the head 78, the second annular step 68, and/or the seal 100 to operatively maintain the flow apertures 96 in fluid communication, and preferably radially aligned, with the second inlet/outlet apertures 72. Preferably, the outside diameter of the head 92 corresponds to the inside diameter of the third bore portion 64*c* to provide a tight slip fit therewith.

The outside diameter of the hollow tube 90 is smaller than the inside diameter of the hollow tube 76, thereby forming an annular gap or outer annular bore 116 therebetween. The outer annular bore 116 defines a part of the first fluid flow path 42 extending from the flow apertures 82 to the distal ends of the first and second hollow tubes 76 and 90. The bore 94 defines a part of the second fluid flow path 44 extending from the flow apertures 96 to the distal end of the hollow tube 90.

The atomizing head 52 is connected to the distal ends of each of the hollow tubes 76 and 90 of the respective first and second flow passage inserts 48, 50. The atomizing head 52 is in the form of a circular cap-like member that covers the distal ends of the hollow tubes 76 and 90. The inner surface of the atomizing head 52 includes a central recess 106 and an annular groove 108 that surrounds the central recess 106. The central recess 106 is aligned axially with the bore 94. The annular groove 108 is aligned axially with the outer annular bore 116. One or more first flow passages 110 extend at an angle from the central recess 106 radially outwardly and axially outwardly. One or more second flow passages 112 extend at an angle from the annular groove 108 radially inwardly and axially outwardly. Each first flow passages 110 intersects with a corresponding second flow passage 112 within an atomizing chamber 114 recessed in the exterior surface of the atomizing head 52. The atomizing chambers 114 define the injection points of the spraywater cloud into the ring body 32. In this arrangement, atomizing steam flowing through the second fluid flow path 44 mixes with and atomizes cooling water flowing through the first fluid flow path 42 inside the atomizing chamber. The atomizing head 52 thereby injects a spraywater cloud generally axially away from the hollow tubes 76 and 90 and generally radially into the ring body 32 toward a central region of steam flowing axially through the ring body 32.

The cap flange 54 covers the second end of the through bore 64 and retains the flow passage inserts 48 and 50 operatively disposed within the through bore 64. The cap flange 54 is connected to the top surface of the body 58, for example, with fasteners or welds. The cap flange 54 preferably forms a fluid tight seal against the body 58 to prevent cooling water and/or atomizing steam from escaping through the second end of the through bore 64. Thus, a seal 118, such as a gasket or o-ring, is sealingly disposed between the cap flange 54 and the top surface of the body 58. The seal is disposed in an annular groove 120 formed in the top surface of the body 58 adjacent the third bore portion 64*c*.

Each of the flow passage inserts 48 and 50, the housing 46, the atomizing head 52, and the cap flange 54 is preferably formed as a separate piece and subsequently assembled together. The flow passage inserts 48 and 50, the housing 46, the atomizing head 52, and the cap flange 54 may be formed by any suitable method, such as by casting, machining, or other sufficient forming methods. Each of the ring body 32, the housing 46, and the first and second flow passage inserts 48 and 50 is preferably formed of metal, such as steel or stainless steel, although other materials may also or alternatively be used. The seals 88, 100, 118 are preferably formed of an elastomeric material, such as rubber, or metal softer than the material of the seating surfaces.

The spray nozzle 34 can be assembled by first inserting the first flow passage insert 48 with the atomizing head 52 attached through the second end of the through bore 64 and seating the annular shoulder 84 against the annular step 66 and/or the seal 88. Thereafter, the second flow passage insert 50 may be inserted through the second end of the through bore 64 and into the inner bore 80 of the first flow passage insert 48. The annular shoulder 98 is seated against the annular step 68, the top surface of the head 78 of the first flow passage insert 48, and/or the seal 100. The cap flange 54 then may be secured and sealingly seated to the top surface of the body 58 and/or against the seal 118, for example, with bolts. The neck 60 is inserted into the aperture 62 through the wall of the ring body 32 either before or after assembling the spray nozzle 34. The neck 60 is sealingly secured in the aperture 62, for example, by welding. Conduits 40*a* and 40*b* may be operatively connected to the respective inlet/outlet apertures 70 and 72 at any convenient point in the assembly process.

Figure 5:
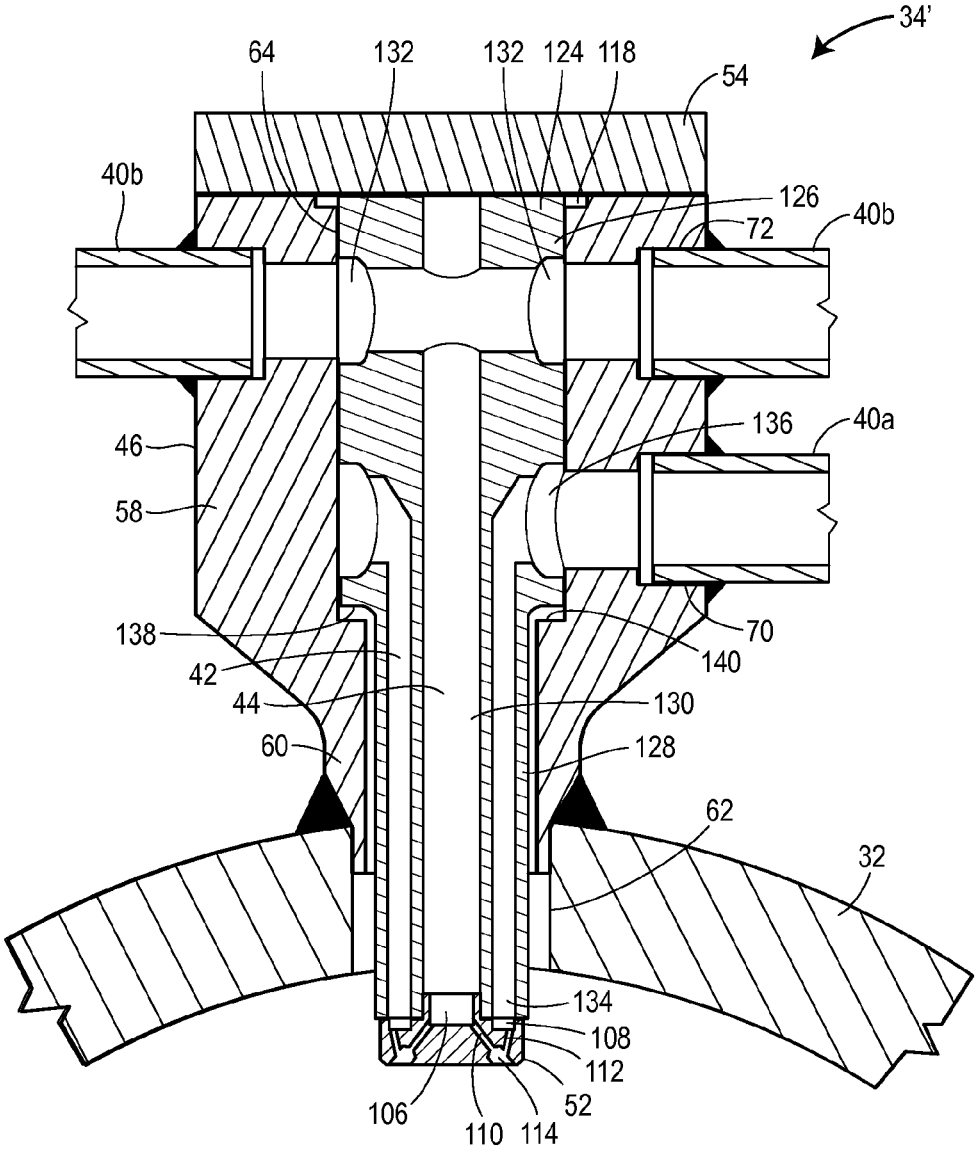
FIG. 5 is a cross-sectional view of another example spray nozzle usable with the desuperheater of FIG. 3 according to the teachings of the present disclosure.

FIG. 5 illustrates a second exemplary arrangement of a spray nozzle 34', which may be used with the desuperheater 30 in lieu of or in addition to the nozzles 34. The spray nozzle 34' is similar to the spray nozzle 34 in that it includes a housing 46 operatively connected to conduits 40*a* and 40*b*.

The housing 46 has a body 58, a neck 60, and a through bore 64 extending from a first open end at a distal end of the neck 60 to a second open end at a top surface of the body 58, one or more first or lower inlet/outlet apertures 70, and one or more second or upper inlet/outlet apertures 72, all as previously described herein. The neck 60 is received with the aperture 62 through the wall of the ring body 32, and sealingly secured to the wall with welds or other sealing and connecting mechanisms. Unlike the spray nozzle 34, however, the spray nozzle 34' includes a single flow passage insert 124 that defines both the first fluid flow path 42 and the second fluid flow path 44 extending from the inlet/outlet apertures 70, 72 to the atomizing head 52.

The flow passage insert 124 includes a head 126 that aligns with the inlet/outlet apertures 70 and 72, a tubular section 128, an inner bore 130, an outer annular bore 134, one or more flow passages 132, 136, and an annular shoulder 138. The tubular section 128 extends from the head 126 to a distal end spaced from the head 126. The inner bore 130 extends axially through the tubular section 128 and the head 126. The inner bore 130 intersects with the flow passages 132. The flow passages 132 extend radially outwardly through an upper portion of the head 126. The outer annular bore 134 surrounds the inner bore 130. The outer annular bore 134 intersects with the flow passages 136, but not with the flow passages 132. The flow passages 136 extend radially outwardly through a lower portion of the head 126. The outer annular bore 134 extends coaxially with the inner bore 130 from the flow passages 136 to the distal end of the tubular section 128. The annular shoulder 138 extends radially from an outer diameter of the tubular section 128 to an outer diameter of the head 126. The annular shoulder 138 forms a radial seating surface that seats against an annular step 140 formed along the through bore 64. The annular shoulder 138 operatively maintains the flow passage insert 124 in the through bore 64 with the flow passages 132 aligned with the upper inlet/outlet apertures 72 and the flow passages 136 aligned with the lower inlet/outlet apertures 70. Thus, the first fluid flow path 42 extends from the lower inlet/outlet aperture 70, through the flow passages 136 and the outer annular bore 134, to the annular groove 108 of the atomizing head 52. The second fluid flow path 44 extends from the upper inlet/outlet aperture 72, through the flow passages 132 and the inner bore 130, to the central recess 106 of the atomizing head 52. The atomizing head 52 is substantially identical as described previously herein and includes the first and second flow passages 110 and 112 connected to each of the bores 130, 134 and converging at an injection point in the atomizing chambers 114. The spray nozzle 34 injects a spraywater cloud of mixed atomized water and atomizing steam axially aligned with the bores 130, and 134 and radially into the ring body 32.

INDUSTRIAL APPLICABILITY

A desuperheater assembly, desuperheater, spray nozzles, and/or components thereof according the teachings of the present disclosure in some applications are useful for reducing the temperature of superheated steam or other fluids or gases in a fluid pipe to a predefined set point temperature. However, the desuperheater assembly, desuperheater, spray nozzles, and/or components thereof are not limited to the uses described herein and may be used in other types of arrangements.

The technical examples described and shown in detail herein are only exemplary of one or more aspects of the teachings of the present disclosure for the purpose of teaching a person of ordinary skill to make and use the invention or inventions recited in the appended claims. Additional aspects, arrangements, and forms of the invention or inventions within the scope of the appended claims are contemplated, the rights to which are expressly reserved.

What is claimed:

1. A desuperheater, comprising:

a ring body defining an axis and an axial flow path;

a plurality of spray nozzles disposed around the ring body, each spray nozzle comprising:

a housing having a bore extending from a first end of the housing to a second end of the housing, a first inlet aperture extending through the housing and intersecting the bore, and a second inlet aperture extending through the housing and intersecting the bore;

a first flow passage insert received within the bore, the first flow passage insert forming a first fluid flow path extending from the first inlet aperture to a distal end of the first flow passage insert;

a second flow passage insert received within the first flow passage insert, the second flow passage insert forming a second fluid flow path, separate from the first flow path, extending from the second inlet aperture to a distal end of the second flow passage insert;

a first seal operatively disposed between the first flow passage insert and the housing to fluidly isolate the first fluid flow path from the second fluid flow path; and an atomizing head that combines cooling water and atomizing steam to form a spraywater cloud and injects the spraywater cloud into the axial flow path in a radial direction, generally perpendicular to the axis of the ring body and the axial flow path;

a water manifold connected to each of the spray nozzles for providing the cooling water to each of the spray nozzles; and a steam manifold connected to each of the spray nozzles for providing the atomizing steam to each of the spray nozzles, separately from the cooling water.

2. The desuperheater of claim 1, wherein:

the water manifold comprises a first conduit operatively connected to each of the spray nozzles, the first conduit arranged to carry the cooling water to the spray nozzles; and the steam manifold comprises a second conduit operatively connected to each of the spray nozzles, the second conduit arranged to carry the atomizing steam to each of the spray nozzles.

3. The desuperheater of claim 1, wherein the first fluid flow path is in fluid communication with the water manifold and the second fluid flow path is in fluid communication with the steam manifold.

4. The desuperheater of claim 3, wherein the second flow passage insert is in fluid communication with the atomizing head and the steam manifold, the second flow passage insert having a bore formed therethrough that defines the second fluid flow path; and a first flow passage insert is in fluid communication with the atomizing head and the water manifold, the first flow passage insert having a bore formed therethrough that, in combination with the second flow passage insert, defines the first fluid flow path.

5. The desuperheater of claim 1, wherein:

the water manifold and the steam manifold are disposed on an exterior side of the ring body;

each spray nozzle extends through an aperture formed in the ring body; and the atomizing heads of the spray nozzles are disposed adjacent an inner wall of the ring body.

6. A ring style steam assisted desuperheater, comprising:

a ring body having a wall defining an axis and an axial flow path extending from a first end of the ring body to a second end of the ring body;

a steam manifold arranged to provide atomizing steam;

a water manifold arranged to provide cooling water; and a spray nozzle operatively connected to each of the steam manifold and the water manifold, the spray nozzle extending through an aperture in the wall of the ring body, wherein the spray nozzle comprises:

a housing coupled to the wall of the ring body, the housing including a bore extending between a first end of the housing and a second end of the housing, a first inlet aperture extending through the housing and intersecting the bore, and a second inlet aperture extending through the housing and intersecting the bore;

a first flow passage insert received within the bore and extending through the first end of the housing, the first flow passage insert defining a first fluid flow path extending from the first inlet aperture and in fluid communication with the water manifold to conduct the cooling water through the spray nozzle;

a second flow passage insert received within the first flow passage insert, the second flow passage insert defining a second fluid flow path, separate from the first fluid flow path, extending from the second inlet aperture and in fluid communication with the steam manifold to conduct the atomizing steam through the spray nozzle, separate from the cooling water; and an atomizing head operatively coupled to the at least one flow passage insert and disposed inside the ring body and adjacent the wall of the ring body, the atomizing head combining the atomizing steam and the cooling water to form a spraywater cloud and directing the spraywater cloud into the ring body in a radial direction, generally perpendicular to the axis of the ring body and the axial flow path.

7. The ring style steam assisted desuperheater of claim 6, wherein the spray nozzle comprises a single flow passage forming both the first fluid flow path and the second fluid flow path.

8. A spray nozzle for a steam assisted ring type desuperheater, comprising:

a housing having a bore extending from a first end of the housing to a second end of the housing, a first inlet aperture extending through the housing and intersecting the bore, and a second inlet aperture extending through the housing and intersecting the bore;

a first flow passage insert received within the bore, the first flow passage insert forming a first fluid flow path extending from the first inlet aperture to a distal end of the first flow passage insert;

a second flow passage insert received within the first flow passage insert, the second flow passage insert forming a second fluid flow path, separate from the first flow path, extending from the second inlet aperture to a distal end of the second flow passage insert;

a first seal operatively disposed between the first flow passage insert and the housing to fluidly isolate the first fluid flow path from the second fluid flow path; and an atomizing head disposed at the distal end of the first flow passage insert and the distal end of the second flow passage insert, the atomizing head having a first flow passage operatively connected to the first fluid flow path and a second flow passage operatively connected to the second fluid flow path, wherein the first flow channel and the second flow channel converge proximate an injection point.

9. The spray nozzle of claim 8, wherein the bore comprises:

a first portion having a first diameter and receiving a hollow tube of the first flow passage insert;

a second portion having a second diameter greater than the first diameter and receiving a head of the first flow passage insert; and a third portion having a third diameter greater than the second diameter and receiving a head of the second flow passage insert;

a first step formed between the first portion and the second portion, the first step configured to engage a shoulder formed on the head of the first flow passage insert; and a second step formed between the second portion and the third portion, the second step configured to engage a shoulder formed on the head of the second flow passage insert.

10. The spray nozzle of claim 9, further comprising a second seal operatively disposed between first flow passage insert and the housing.

11. The spray nozzle of claim 8, further comprising a cap flange secured to the first end of the housing sealing the bore, wherein the cap flange secures the first flow passage insert and the second flow passage insert within the bore.

12. The spray nozzle of claim 11, further comprising a third seal operatively disposed between the cap flange and the housing.

13. A spray nozzle for a steam assisted ring type desuperheater, comprising:

a housing having a bore extending from a first end of the housing to a second end of the housing, a first inlet aperture extending through the housing and intersecting the bore, and a second inlet aperture extending through the housing and intersecting the bore;

a flow passage insert received within the bore, the flow passage insert forming a first fluid flow path extending between and fluidly connecting the first inlet aperture and a distal end of the flow passage insert and a second fluid flow path, fluidly separated from the first fluid flow path, extending between and fluidly connecting the second inlet aperture and the distal end of the flow passage insert; and an atomizing head disposed at the distal end of the flow passage insert, the atomizing head having a first flow passage in fluid communication with the first fluid flow path and the first inlet aperture and a second flow passage in fluid communication with the second fluid flow path and the second inlet aperture, the first fluid flow path and the second fluid flow path converging proximate an injection point.

14. The spray nozzle of claim 13, wherein the bore comprises:

a first portion having a first diameter and receiving a tubular section of the flow passage insert;

a second portion having a second diameter greater than the first diameter and receiving a head of the flow passage insert; and a step formed between the first portion and the second portion, the step configured to engage an annular shoulder formed on the head of the flow passage insert.

15. The spray nozzle of claim 14, wherein:

the first fluid flow path comprises an outer annular bore extending axially along the tubular section to a first flow passage formed in the head;

the second fluid flow path comprises an inner bore disposed within the outer annular bore and extending axially along the tubular section to a second flow passage formed in the head;

first flow passage is in fluid communication with the first inlet aperture; and the second flow passage is in fluid communication with the second inlet aperture.

16. The spray nozzle of claim 14, further comprising a cap flange secured to the first end of the housing and sealing the bore, wherein the cap flange secures the flow passage insert within the bore.

17. The spray nozzle of claim 16, further comprising a seal operatively disposed between the cap flange and the housing.

* * * * *